US007921941B2

(12) United States Patent
Aros

(10) Patent No.: US 7,921,941 B2
(45) Date of Patent: Apr. 12, 2011

(54) PRESSURIZED FLUID FLOW SYSTEM FOR A REVERSE CIRCULATION HAMMER

(75) Inventor: Jaime Andres Aros, Santiago (CL)

(73) Assignee: Drillco Tools S.A., Santiago (CL)

( * ) Notice: Subject to any disclaimer, the term of this patent is extended or adjusted under 35 U.S.C. 154(b) by 46 days.

(21) Appl. No.: 12/199,988

(22) Filed: Aug. 28, 2008

(65) Prior Publication Data

US 2009/0188723 A1 Jul. 30, 2009

Related U.S. Application Data

(60) Provisional application No. 61/006,698, filed on Jan. 28, 2008.

(51) Int. Cl.
*E21B 4/14* (2006.01)

(52) U.S. Cl. ..... 175/296; 175/293; 175/212; 175/65

(58) Field of Classification Search ..... 175/162, 175/212, 29.3, 296, 414, 417, 293
See application file for complete search history.

(56) References Cited

U.S. PATENT DOCUMENTS 4,084,646 A 4/1978 Kurt
4,312,412 A 1/1982 Pillow
4,694,911 A * 9/1987 Kennedy ..... 173/62
4,819,746 A 4/1989 Brown et al.
4,923,018 A 5/1990 Meek
5,113,950 A 5/1992 Krasnoff
5,154,244 A 10/1992 Elsby et al.
5,279,371 A 1/1994 Ekwall et al.
5,396,965 A * 3/1995 Hall et al. ..... 173/73
5,407,021 A 4/1995 Kane et al.
5,685,380 A 11/1997 Purcell et al.
RE36,002 E 12/1998 Elsby et al.
5,944,117 A 8/1999 Burkholder et al.
5,984,021 A 11/1999 Pascale
6,135,216 A 10/2000 Lyon et al.
6,454,026 B1 9/2002 Shofner
6,702,045 B1 3/2004 Elsby

* cited by examiner

*Primary Examiner* — David J Bagnell
*Assistant Examiner* — Elizabeth C Gottlieb
(74) *Attorney, Agent, or Firm* — Ladas & Parry LLP

(57) ABSTRACT

A pressurized fluid flow system for a reverse circulation down-the-hole hammer having a cylinder coaxially disposed in between an outer casing and the piston. This piston reciprocates due to changes in pressure of the pressurized fluid contained inside of a front chamber and a rear chamber at opposite sides of the piston, where the flow into and out of these chambers is controlled solely by the overlap or relative position of the piston and the cylinder as a supply chamber and a discharge chamber, which are defined by recesses on the inner surface of the outer casing and separated by a dividing wall, respectively, supply to and discharge from the front and rear chambers, the pressurized fluid. An internal chamber may also be provided in between the piston and a sampling tube coaxial with the outer casing for a more efficient filling of the chambers.

14 Claims, 6 Drawing Sheets

PRESSURIZED FLUID FLOW SYSTEM FOR A REVERSE CIRCULATION HAMMER

FIELD OF APPLICATION OF THE INVENTION

The present invention relates generally to pressurized fluid flow systems for percussive mechanisms operating with said fluid, particularly for DTH (Down-The-Hole) hammers and more particularly for reverse circulation DTH hammers, and to DTH hammers with said systems.

STATE OF THE ART

DTH Hammers

A numerous variety of percussive drilling mechanisms exist which use a pressurized fluid as the means for transmitting power. Among these are DTH hammers which are widely used in the drilling industry, in mining as well as civil works and the construction of water, oil and geothermal wells. The DTH hammer, of cylindrical shape, is used assembling it on a drill rig located at ground surface. The drill rig also comprises a drill string comprising rods assembled together, the top end being assembled to a rotation and thrust head and the bottom end coupled to the hammer. Through this drill string the drill rig supplies the necessary pressurized fluid to the hammer for the hammer to operate.

Parts of the DTH Hammer

The main movable part of the hammer is the piston. This member of the hammer has an overall cylindrical shape and is coaxially and slidably disposed in the inside of a cylindrical outer casing. When the hammer is operative in the mode known as "drilling mode", the piston effects a reciprocating movement due to the change in pressure of the pressurized fluid contained in two main chambers, a front chamber and a rear chamber, formed inside the hammer and located at opposite ends of the piston. The piston has a front end in contact with the front chamber and a rear end in contact with the rear chamber, and has outer sliding surfaces or sliding sections of the outer surface of the piston (as opposed to sections with recess areas, grooves or bores) and inner sliding surfaces or sliding sections of the inner surface of the piston (again as opposed to sections with recess areas, grooves or bores). The outer sliding surfaces are mainly designed for ensuring guidance and alignment of the piston within the hammer. Besides, in most hammers these surfaces, together with the inner sliding surfaces of the piston, in cooperation with other elements as described further along in these specifications, permit control of the alternate supply and discharge of pressurized fluid into and from the front and rear chambers.

The foremost part of the hammer, which performs the drilling function, is known as the drill bit and it is slidably disposed on a driver sub mounted in the front end of the outer casing, the drill bit being in contact with the front chamber and adapted to receive the impact of the front end of the piston.

In order to ensure the correct alignment of the drill bit with respect to the outer casing, a component known as drill bit guide is normally used, which is disposed in the inside of the outer casing. The rotating movement provided by the drill rig is transmitted to the drill bit by means of fluted surfaces in both the drill bit and driver sub. In turn the drill bit head, of larger diameter than the outer casing and than the driver sub, has mounted therein the cutting elements that fulfill the drilling task and extend forward from the drill bit front face. The movement of the drill bit is limited in its rearward stroke by the driver sub and in its forward stroke by a retaining element especially provided for said purpose. At the rear end of the hammer a rear sub is provided that connects the hammer with the drill string and ultimately to the source of pressurized fluid.

In the above description and that one hereinafter provided, the rear end of the hammer is understood to be the end where the rear sub is located and the front end of the hammer, the end where the drill bit is located.

Operation of the Hammer

When the hammer operates in the drilling mode, the front and rear chambers undergo the following states:

a—supply of pressurized fluid, wherein the fluid coming from the source of pressurized fluid is free to flow into the chamber;

b—expansion or compression, depending on the direction of the piston's movement, wherein the chamber is tightly sealed and the volume it encloses increases or decreases;

c—discharge of pressurized fluid, wherein the fluid coming from the chamber is free to flow towards the bottom of the hole; this discharge flow enables flushing of the rock cuttings generated by the drill bit, dragged in suspension in the pressurized fluid flow, towards the ground surface (process known as flushing of the hole).

In accordance with the piston's reciprocating movement, starting from the position in which the piston is in contact with the drill bit and the latter is disposed at the rearmost point of its stroke (position known as impact position), and ending in the same position (with the impact of the piston over the drill bit), the respective sequence for the states of the front and rear chambers are the following: [a-b(expansion)-c-b(compression)-a] and [c-b(compression)-a-b(expansion)-c]. The transition from one state to the other is independent for each chamber and is controlled by the position of the piston with respect to other parts of the hammer in such a way that the piston acts in itself as a valve, as well as an impact element.

In a first operative mode or "drilling mode", when pressurized fluid is supplied to the hammer and the hammer is in the impact position, the piston immediately begins the reciprocating movement and the drill bit is impacted in each cycle by the piston, the front end of the drill bit thereby performing the function of drilling the rock at each impact. The rock cuttings are exhausted to the ground surface by the pressurized fluid discharged from the front and rear chambers to the bottom of the hole. As the depth of the hole increases, the magnitude of the pressurized fluid column with rock cuttings also increases, producing a greater resistance to the pressurized fluid discharge from the chambers. This phenomenon negatively affects the drilling process. In some applications the leakage of water or other fluid into the hole increases even more this resistance, and the operation of the hammer may cease.

In some hammers, this operative mode of the hammer can be complemented with an assisted flushing system which allows discharge of part of the flow of pressurized fluid available from the source of pressurized fluid directly to the bottom of the hole without passing through the hammer cycle. The assisted flushing system allows the hole to be cleaned thoroughly while it is being drilled.

In a second operative mode of the hammer or "flushing mode", the drill string and the hammer are lifted by the drill rig in such a way that the drill bit loses contact with the rock and all the pressurized fluid is discharged through the hammer directly to the bottom of the hole for cleaning purposes without going through the hammer cycle, thus ceasing the reciprocating movement of the piston.

The pressurized fluid coming from the assisted flushing system has an energy level substantially similar to that of the pressurized fluid coming out from the source of pressurized fluid, as opposed to what happens with the pressurized fluid exhausted from the chambers, which is at a pressure substantially lower due to the exchange of energy with the piston.

Industrial Applications

These drilling tools are used in two fields of industrial application:

1) Production, where a kind of hammer known as "normal circulation hammer" is used, wherein the rock cuttings produced during the drilling operation are flushed to the ground surface through the annular space defined by the wall of the hole and the outer surface of the hammer and the drill string, producing wear on the outer surfaces of the hammer and the drill string by the action of said cuttings. The pressurized fluid coming from the chambers and from the assisted flushing system is discharged through a central passage inside the drill bit which extends from its rear end to its front end. This passage may be divided into two or more passages ending in the front face of the drill bit in such a way that the discharge of the pressurized fluid is mainly generated from the center and across the front face of the drill bit towards the peripheral region of the same and towards the wall of the hole, and then towards the ground surface along the annular space between the hammer and the wall of the hole and between the drill string and the wall of the hole. The rock cuttings are exhausted by drag and are suspended in the pressurized fluid discharged to the bottom of the hole.

Normal circulation hammers are used in mining in underground and surface developments. Due to their ability to drill medium to hard rock, the use of this type of hammers has also extended to the construction of oil, water and geothermal wells. In general the soil or rock removed is not used as it is not of interest and suffers from contamination on its path to the surface.

2) Exploration, where a kind of hammer known as "reverse circulation hammer" is used, which allows the rock cuttings from the bottom of the hole to be recovered at the ground surface by means of the pressurized fluid discharged to the bottom of the hole. The pressurized fluid coming from the chambers is discharged along the peripheral region of the front end of the drill bit, therefore producing a pressurized fluid flow across the front face of the drill bit towards the inside of a continuous central passage formed along the center of the hammer, typically through an inner tube known as sampling tube extending from the drill bit to the rear sub, and through the double walled rods that conform the drill string. This central passage begins in the inside of the drill bit at a point where two or more flushing passageways originated in the front face of the drill bit converge. The rock cuttings are dragged towards the central passage by the action of the pressurized fluid, said rock cuttings being recovered at the ground surface. The pressurized fluid flow with suspended rock cuttings produce wear on the inner surfaces of all the elements that form said central passage.

Either, the drill bit or a cylindrical sealing element of the hammer which has a diameter substantially similar to the diameter of the drill bit head and larger than the external diameter of the outer casing, performs the function of preventing the leakage of pressurized fluid and rock cuttings into the annular space between the hammer and the wall of the hole and between the drill string and the wall of the hole when the hole is being drilled (as happens with a normal circulation hammer), forcing these cuttings to travel through the sampling tube and drill string to the ground surface by the action of the pressurized fluid. If it is the drill bit that performs this sealing function, it has a peripherial region that isolates the front face of the drill bit from said annular space.

The use of this type of drilling tool allows for the recovery of more than 90% of the rock cuttings, which do not suffer from contamination during their travel to the ground surface and are stored for further analysis.

Performance Parameters

From the user's point of view, the parameters used to evaluate the performance and usefulness of the hammer are the following:

1) rate of penetration, which is given by the power generated in the pressurized fluid cycle in the hammer and which value depends on two variables: the pressurized fluid consumption and the cycle's energy conversion efficiency, this being defined as the power generated per unit of pressurized fluid mass consumed;
2) durability of the hammer related to wear induced by the pressurized fluid flow dragging rock cuttings toward the ground surface, the durability being strongly dependent on the characteristics of the rock cuttings and the thickness of the parts in contact with the pressurized fluid flow;
3) consumption of pressurized fluid, which is strongly dependent on the passive volume of the front chamber, the passive volume of the rear chamber and the design of the pressurized fluid cycle of the hammer;
4) deep drilling capacity, which depends on the ability of the hammer to deliver pressurized fluid with a high level of energy to the bottom of the hole;
5) manufacturing costs, which depend on manufacturing complexity, the amount of components of the hammer and the amount of raw material used, and
6) rock cuttings recovery efficiency (only for reverse circulation hammers), which is mainly related with the capacity of the hammer to seal the hole and prevent the leakage of pressurized fluid and rock cuttings to the annular space formed between the hammer and the wall of the hole and between the drill string and the wall of the hole.

It should be noted that the rate of penetration, durability of the hammer, pressurized fluid consumption and deep drilling capacity are factors that have direct incidence in the operational cost for the user. In general, a faster hammer having a useful life within acceptable limits will always be preferred for any type of application.

Pressurized Fluid Flow Systems

Different pressurized fluid flow systems are used in hammers for the process of supplying the front chamber and the rear chamber with pressurized fluid and for discharging the pressurized fluid from these chambers. In all of them there is a supply chamber formed inside the hammer from which, and depending on the position of the piston, the pressurized fluid is conveyed to the front chamber or to the rear chamber. In general, the piston acts as a valve, in such a manner that depending on its position is the state in which the front and rear chambers are, these states being those previously indicated: supply, expansion-compression and discharge.

At all times the net force exerted on the piston is the result of the pressure that exists in the front chamber, the area of the piston in contact with said chamber (or front thrust area of the piston), the pressure that exists in the rear chamber, the area of the piston in contact with said chamber (or rear thrust area of the piston), the weight of the piston and the dissipative forces that may exist. The greater the thrust areas of the piston, the greater the force generated on the piston due to the pressure of the pressurized fluid and greater the power and energy conversion efficiency levels which can be achieved.

All the prior art pressurized fluid flow systems described in the following paragraphs are described with regard to the solutions for controlling the state of the front and rear chambers of a DTH hammer. The examples described refer to normal circulation hammers but they are equally applicable to reverse circulation hammers.

Type A Flow System, Represented by U.S. Pat. No. 4,084,646, U.S. Pat. No. 5,944,117 and U.S. Pat. No. 6,135,216

The designs described in these patents comprise a cylinder mounted inside the outer casing, the cylinder creating a fluid passageway between the outer surface of said cylinder and the inner surface of the outer casing. This fluid passageway extends along the rear half of the piston and ends in the supply chamber, which is partially defined by the outer sliding surface of the piston, near its middle point, and the inner surface of the outer casing. The provision of this cylinder requires the use of a dual outer diameter piston, the outer diameter of the same being greater at its front end and smaller at its rear end where the cylinder is placed.

The region where the piston's outer diameter changes, i.e. where there is a shoulder on the outer sliding surface of the piston, is subject to a pressure equal in average to the supply pressure of the hammer. Therefore, on each cycle the net work exerted by this region on the piston is null, i.e. it does not contribute with the energy transfer process to the piston, resulting in a reduced rear thrust area.

Moreover, in the normal or reverse circulation hammers with this type of flow system, an air guide is provided for controlling the discharge of the rear chamber, the air guide being a tubular element coaxial with the piston and the outer casing and located at the rear face of the rear chamber. Also, a footvalve is provided in order to control the discharge of the front chamber, the footvalve being a hollow tubular element coaxial with the piston and the outer casing and emerging from the rear face of the drill bit, known as impact face.

The above requires the use of a piston with a central bore, the bore extending along its entire length and interacting with the air guide and with the footvalve, This central bore reduces even more the rear thrust area and the front thrust area of the piston, which causes as a result a cycle of even less power.

Moreover, the alignment of the cylinder is a frequent problem in this type of design, which if is not addressed, induces dissipative forces that drain power from the hammer's cycle.

Type B Flow System, Represented by U.S. Pat. No. 5,984,021, U.S. Pat. No. 4,312,412 and U.S. Pat. No. 6,454,026

The designs described in these patents comprise a pressurized fluid feed tube (inside of which the supply chamber is generated), which extends from the rear face of the rear chamber and is received inside a central bore in the piston. This bore extending along the whole length of the piston.

In order to control the feed of the front chamber and of the rear chamber with pressurized fluid and control the discharge of the rear chamber, the feed tube interacts with bores and undercuts inside the piston.

Undercuts on the outer sliding surface of the piston and on the inner surface of the outer casing complement the piston's control of the state of the chambers. Further, the discharge of the front chamber is controlled by a footvalve formed in the drill bit (U.S. Pat. No. 5,984,021 and U.S. Pat. No. 4,312,412) or alternatively by a front portion of the piston of smaller diameter that interacts with a piston guide (U.S. Pat. No. 6,454,026). This last solution can also be used as an alternative to the footvalve in the Type A flow system and in the rest of the flow systems which will be described hereinafter.

The presence of bores across the piston weakens the impact strength of this part of the hammer and implies a more complex manufacturing process. From this point of view, hammers with the Type A flow system have a stronger piston and a simpler manufacturing process than the hammers with the Type B flow system. In addition, the creation of the supply chamber inside the feed tube produces a delay in the initiation of the flow when the supply of pressurized fluid to the chambers is enabled, due to the distance between the former and the latter. The bores also cause an increment in the passive volumes of the chambers, being the main consequence of this a rise in the consumption of pressurized fluid and a reduction in the energy efficiency conversion in the thermodynamic cycle.

In the particular case of hammers that have a piston with a front portion of smaller diameter that interacts with a piston guide, the front thrust area of the piston is highly reduced due to the fact that a sufficiently large impact area is still required in order to withstand the stress generated by the impact, thus taking away surface from the front thrust area.

Moreover, the provision of a feed tube requires the use of a piston having a central bore extending along its entire length, resulting in the effects on power already mentioned for the Type A system.

Type C Flow Systems, Represented by the U.S. Pat. No. 4,923,018

The design described in this patent has three different sets of supply passages built in the outer casing. The first set of passages end at the inner surface of the outer casing and create a supply chamber between the outer sliding surface of the piston and the inner surface of the outer casing. The second and third sets of passages allow for the flow of pressurized fluid from the supply chamber toward the front chamber and toward the rear chamber respectively. In order to control the supply of pressurized fluid to the front chamber and to the rear chamber, the supply chamber interacts with recesses in the outer sliding surface of the piston and with the second and third sets of passages in the outer casing, while the discharge of the front chamber and the rear chamber are respectively controlled with the use of a footvalve and an air guide (refer to the Type A flow system applied to a normal circulation hammer).

The main disadvantages of this design is the addition of passive volume due to the presence of the second and third sets of passages and the fact that these passages significantly reduce the useful life of the outer casing which is largely dependent on the thickness of its wall. Also, the provision of an air guide and footvalve requires the use of a piston having a central bore extending along its entire length, resulting in the effects on power already mentioned for the Type A system.

Type D Flow System, Represented by U.S. Pat. No. 5,113,950 and U.S. Pat. No. 5,279,371

In the designs described in these patents a supply chamber is provided in the rear end of the piston, the designs have similar characteristics to the Type A and Type B flow systems. The Type D flow system uses a central feed tube as in the Type B flow system, but differs from the latter in that the supply chamber is not created inside the feed tube. Instead, similarly to the Type A flow system, the supply chamber is created and acts on a portion of the rear end of the piston. In this manner the feed tube performs the function of helping to convey the pressurized fluid toward the supply chamber and does not participate in its creation. All this produces as a consequence a reduction in the piston's rear thrust area. Moreover, the need to discharge the rear chamber requires the use of a piston with a central bore that emerges on the front face of the same, thus reducing even more the rear thrust area and the front thrust area of the piston, which results in a cycle of even less power.

Further, in U.S. Pat. No. 5,113,950 the presence of recesses and bores through the piston weaken the impact strength of this component.

In the following paragraphs the different known pressurized fluid flow systems are described for the specific case of reverse circulation hammers, with regard to the solutions for conveying the pressurized fluid discharged from the front chamber and from the rear chamber to the bottom of the hole, specifically to the periphery of the front face of the drill bit, for flushing of rock cuttings.

Type I Flow System, Represented by the U.S. Pat. No. 5,154,244, RE36002(US), U.S. Pat. No. 6,702,045 and U.S. Pat. No. 5,685,380.

These patents describe a flow system where the pressurized fluid is conveyed from the rear end of the drill bit to the front end of the same by means of channels created in the outer surface of the drill bit. These channels cooperatively work with splines on the driver sub inner surface and with a ring or sleeve acting as sealing element so as to form enclosed passages in such a manner as to discharge the pressurized fluid to the periphery of the front end of the drill bit.

In a variant of the former solution described in U.S. Pat. No. 6,702,045, a flow system is shown where the pressurized fluid is conveyed from the rear end of the drill bit up to an intermediate point on the outside of the same by means of channels created on the outer surface of the drill bit. These channels cooperatively work with the splines of the driver sub to create enclosed passages. From this intermediate point the flow of pressurized fluid is deviated through bores in the driver sub to a passage formed between the outer surface of the driver sub and the inner surface of the sealing ring or sleeve in such a manner as to discharge the pressurized fluid at the peripheral region of the front end of the drill bit.

From the point of view of the control of the state of the front and rear chambers, commercial designs from these patents are of the Type A and Type D flow systems. As with the Type B flow system, a front region of the piston of smaller diameter that interacts with a piston guide is used as an alternative solution to the footvalve for controlling the discharge of the front chamber. The discharge of the rear chamber is controlled by means of an air guide that opens or blocks the flow of pressurized fluid from the rear chamber to a central coaxial channel formed between the inner sliding surface of the piston and the outer surface of the sampling tube, this passage extending from the rear chamber to the rear end of the drill bit.

The disadvantages of this flow system are the same ones as those associated with the Type A and Type D flow systems and, in particular, impact negatively the design of the drill bit in two aspects. The first one is the need for a multiplicity of manufacturing processes for producing the channels in the outer surface of the drill bit, which increases the manufacturing cost of the hammer. The second is that, due to the presence of these channels, the drag surface of the splines, which depend on the contact area of each spline individually and the total number of splines, can in some applications be insufficient. This last problem can be counterbalanced by lengthening the drill bit, but this implies increasing the cost of the hammer.

Type 2 Flow System, Represented by U.S. Pat. No. 5,407,021 and U.S. Pat. No. 4,819,746

U.S. Pat. No. 5,407,021 and U.S. Pat. No. 4,819,746 describe a flow system where the pressurized fluid is conducted from the rear end of the drill bit up to an intermediate point on the outside of the same by means of channels formed on the outer surface of the drill bit. These channels work cooperatively with the splines of the driver sub for generating enclosed passages. From this intermediate point the flow is deviated through mainly longitudinal bores created on the head of the drill bit in such a way as to discharge the pressurized fluid at the peripheral region of the front end of the drill bit.

The bit head has the further function of avoiding the escape of pressurized fluid through the annular space formed between the hammer and the wall of the hole and between the rods and the wall of the hole.

From the perspective of controlling the state of the front and rear chambers, U.S. Pat. No. 4,819,746 has a Type A flow system.

In both patents, as an alternative solution to the foot valve for controlling the discharge of the front chamber, a front portion of the piston of a smaller diameter is used that interacts with a piston guide, as described in the Type B flow system.

The discharge of the rear chamber is controlled by an air guide (U.S. Pat. No. 4,819,746) which opens or closes the flow of pressurized fluid from the rear chamber to a central coaxial channel formed in between the inner sliding surface of the piston and the outer surface of the sampling tube, which extends up to the rear end of the drill bit.

The disadvantages in this case (U.S. Pat. No. 4,819,746) are the same as those of the Type A flow system and the design of the drill bit is also negatively impacted in the same two aspects already mentioned for the Type 1 flow system plus a third aspect. This third aspect is given by the mechanical weakness induced on the drill bit as a result of the mainly longitudinal bores made on the head of the drill bit for channeling the pressurized fluid and discharging it at the peripheral region of the front end of the drill bit so as to produce a flow of pressurized fluid from the periphery along the front face of the drill bit towards the inside of the central coaxial passage of the hammer and the rods.

OBJECTIVES OF THE INVENTION

According with the issues and technical antecedents stated, it is a goal of the present invention to present a pressurized fluid flow system which, applied to a reverse circulation hammer, provides a better performance than the reverse circulation hammers of the previous art. Specifically and without sacrificing useful life, it would be desirable to have a reverse circulation hammer improved in the following aspects:

- a high power and high efficiency in the energy conversion process, which implies a higher penetration rate and a lower pressurized fluid consumption, respectively, and
- a structurally simpler design and reduced manufacturing cost An additional goal of the present invention is to provide a reverse circulation hammer having improved deep drilling capacity without a noticeable reduction neither in the penetration rate nor in the rock cuttings recovery capacity.

Finally, it is a goal of the invention to provide an improved pressurized fluid flow system for a reverse circulation DTH hammer that, in terms of control of the state of the front and rear chambers, it can also be applicable to a normal circulation DTH hammer if desired.

SUMMARY OF THE INVENTION

With the purpose of providing a pressurized fluid flow system for a reverse circulation DTH hammer according to the above-defined goals, a design has been adopted as solution that makes an efficient use of the cross-sectional area of the hammer and employs fewer parts and is simpler to manufacture.

Further, the pressurized fluid flow system of the invention incorporates an assisted flushing system. In this manner, the required improved deep drilling capacity of the hammer is met without a noticeable reduction neither in the penetration rate nor the rock cuttings recovery capacity.

Moreover, as far as control of the front and rear chambers is concerned, the pressurized fluid flow system of the invention is especially designed for a reverse circulation DTH hammer as opposed to the prior art where reverse circulation DTH hammers are adapted from pressurized fluid flow systems designed for normal circulation hammers.

The pressurized fluid flow system of the invention is characterized by having a cylinder coaxially disposed in between the outer casing and the piston; and two chambers, a supply chamber and a discharge chamber, delimited by the outer surface of the cylinder and the inner surface of the outer casing, and separated by a dividing wall. The supply chamber is permanently filled with fluid coming from the source of pressurized fluid and connected without interruption to the outlet of said source. The discharge chamber is permanently communicated with the bottom of the hole drilled by the hammer. Preferably, the supply chamber is disposed in series longitudinally with the discharge chamber and both chambers are defined by two recesses on the inner surface of the outer casing.

In a first embodiment of the invention, the flow of pressurized fluid supplied into and discharged from the front and rear chambers is controlled solely by the overlap or relative position of the outer sliding surfaces of the piston with the inner surface of the cylinder. For channeling the pressurized fluid from the supply chamber to the front and rear chambers of the hammer and from the latter chambers to the discharge chamber, first and second set of fluid-conducting means are provided in the piston and multiple supply and discharge through-ports are provided in the cylinder, these supply and discharge through-ports respectively facing the supply and discharge chambers.

In a second embodiment of the invention, the piston comprises an internal chamber in between the piston and the sampling tube, defined by a recess of the inner sliding surfaces of the piston. The internal chamber is in permanent fluid communication with the supply chamber and it is preferably disposed coaxial to both the piston and the sampling tube.

During the stages where the front chamber and the rear chamber are supplied with pressurized fluid, the pressurized fluid flow is controlled by the overlap of the outer sliding surface of the sampling tube with the inner sliding surfaces of the piston. Moreover, the creation of an internal chamber in between the piston and the sampling tube, and the overlap or relative position of the outer sliding surface of the sampling tube with the inner sliding surfaces of the piston for controlling the supply of pressurized fluid to the front chamber and to the rear chamber permit a more efficient filling of these chambers in every cycle of the hammer and reduces the magnitude of the passive volumes in both chambers.

Therefore, the state of the front chamber and the rear chamber are controlled in the invention by the interaction of a single pair of components, or at the most three components of the hammer, compared to the previous art where the control is achieved with a larger number of components interacting together.

The above-mentioned configurations enable an optimal use of the cross sectional area of the hammer compared to prior art hammers. When observing the front thrust area and the rear thrust area of pistons in prior art hammers, it is possible to verify that the cross sectional area of these pistons are mainly shared by the piston, the outer casing, the sampling tube and the areas reserved for supplying the front chamber and rear chamber with pressurized fluid, and the areas reserved for discharging the pressurized fluid from the front chamber and rear chamber. By disposing the supply chamber in series longitudinally with the discharge chamber it is possible to increase the front thrust area and the rear thrust area of the piston due to the fact that they only share the cross sectional area with the area occupied by the discharge chamber and the supply chamber, respectively.

The front thrust area and the rear thrust area of the piston under the configurations of the invention are identical or practically identical in size. Additionally, control of the discharge of the front chamber and the rear chamber by interaction between the piston and the cylinder in both embodiments, makes it unnecessary to have either a foot valve or a front portion of the piston of smaller diameter interacting with a piston guide or an air guide for this purpose, thus avoiding the additional losses in the thrust areas as it occurs with the flow systems of the prior art.

Furthermore, having the pressurized fluid flow system of the invention a discharge chamber adjacent to the inner surface of the outer casing allows to divert the pressurized fluid flow to the outside of the outer casing through one or more end discharge ports built in its wall, and to discharge it to the peripheral region of the front end of the drill bit. This enables a simplified drill bit design.

Moreover, one or more flushing channels may be provided in the dividing wall for permitting part of the flow of pressurized fluid available from the source of pressurized fluid to be discharged directly to the bottom of the hole, conforming in this fashion an assisted flushing system and enabling the desired increased deep drilling capacity without a noticeable reduction neither in the penetration rate nor the cuttings recovery capacity. Such channels are preferably longitudinal channels, more preferably helixes and in a preferred option of the invention the flushing channels are interlaced with annular seal-mounting grooves for mounting on them removable fluid seals that when mounted on the grooves disable the assisted flushing system.

It is important to mention that the design principles behind the pressurized fluid flow system herein described with reference to a reverse circulation hammer are equally applicable to a normal circulation hammer.

The invention also comprises a reverse circulation DTH hammer characterized by having either of the pressurized fluid flow system embodiments described above and by discharging the pressurized fluid from the discharge chamber through the end discharge ports, out of the outer casing and along the sides of the front end portion of the same. Preferably these end discharge ports are connected to respective longitudinal discharge channels formed on the outer surface of the front end portion of the outer casing and both, ports and channels, are covered by a sealing element such as a shroud or outer sealing sleeve, so as to direct the pressurized fluid to the peripheral region of the front end of the drill bit and producing a pressurized fluid flow across the front face of the drill bit which drags the rock cuttings towards the inside of the continuous central passage formed along the center of the hammer. This feature is possible thanks to the fact that the rear chamber as well as the front chamber discharge into the mentioned discharge chamber. In this respect, the design of the hammer and specifically of the bit is simpler and sturdier and it is specifically adapted for a reverse circulation cycle, as opposed to known reverse circulation DTH hammers where discharge of pressurized fluid to the bottom of the hole is achieved by more centrally located fluid-conducting means because their flow systems are adapted from normal circulation cycles.

To facilitate the understanding of the precedent ideas, the invention is described making reference to the attached drawings.

In all these figures, the flow system of the hammer has also been depicted with respect to the solution designed under the invention to convey the pressurized fluid to the bottom of the hole from the front chamber and rear chamber, in all the modes, states and for both embodiments, specifically to the peripheral region of the front end of the drill bit for flushing the rock cuttings. The direction of the pressurized fluid flow has been indicated by means of arrows.

Figure 1:
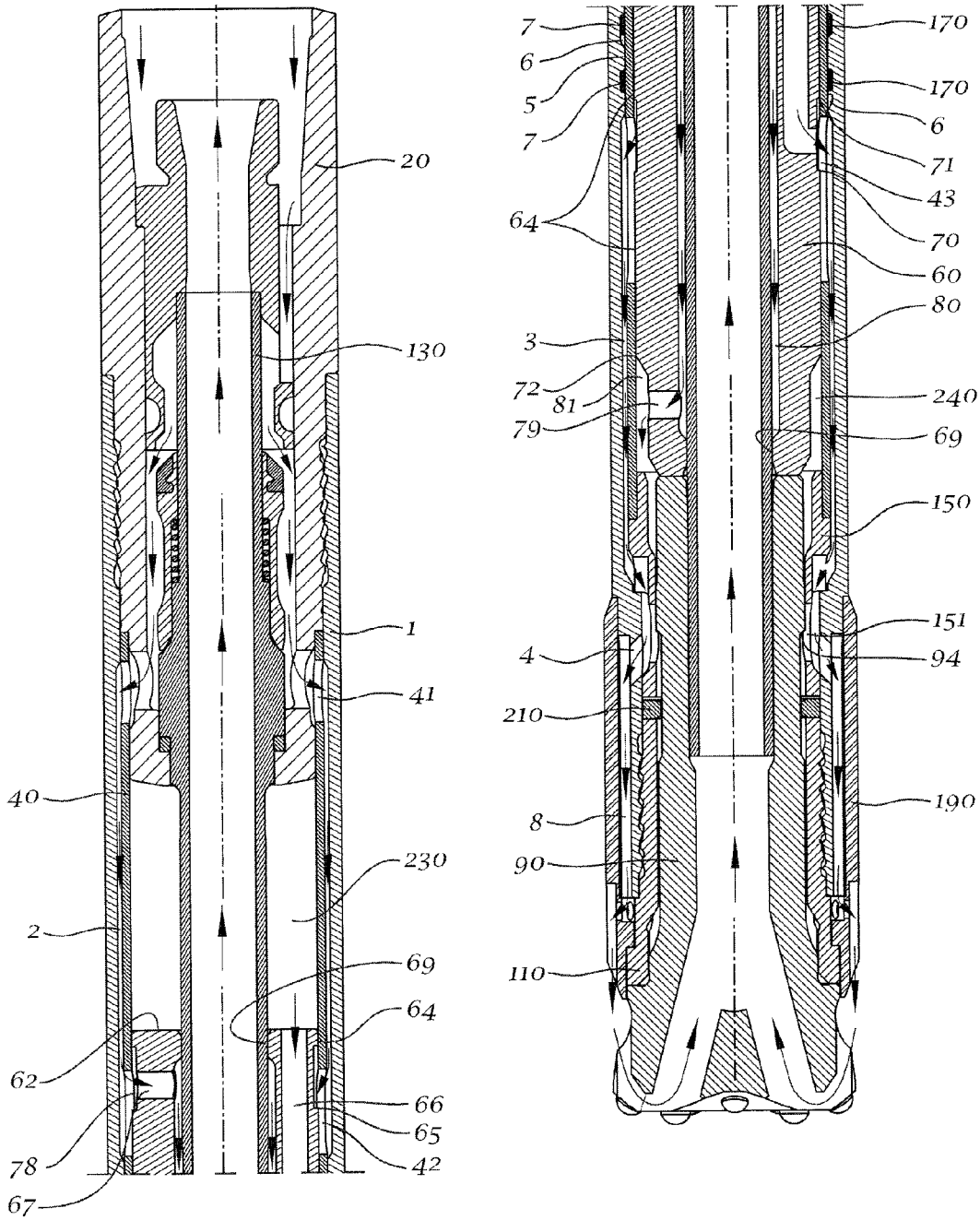
FIG. 1 depicts a longitudinal cross section view of the reverse circulation DTH hammer of the invention specifically showing the disposition of the piston with respect to the outer casing, cylinder, drill bit and sampling tube when the front chamber is being supplied with pressurized fluid and the rear chamber is discharging pressurized fluid to the bottom of the hole.
Figure 2:
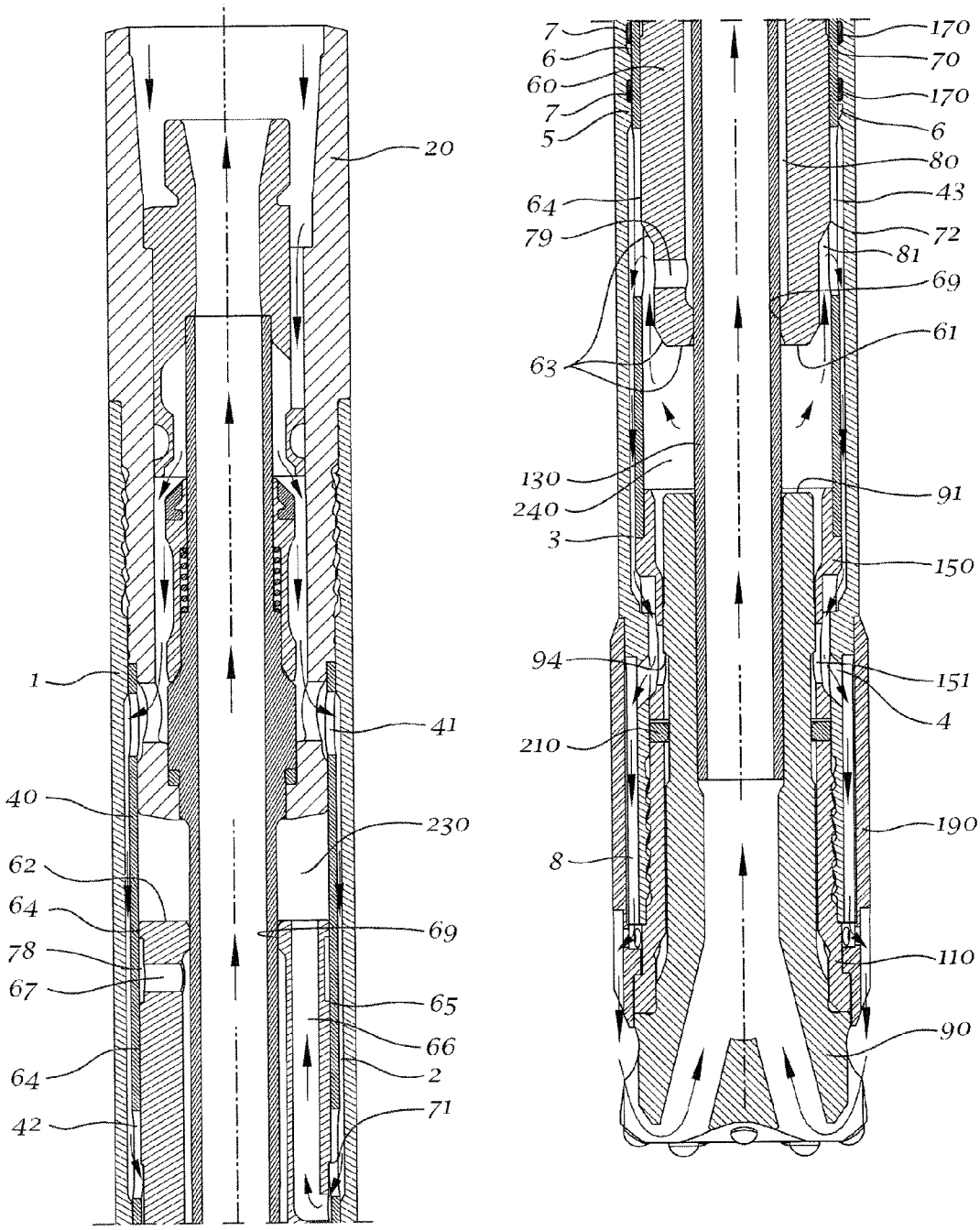
FIG. 2 depicts a longitudinal cross section view of the reverse circulation DTH hammer of the invention specifically showing the disposition of the piston with respect to the outer casing, cylinder, drill bit and sampling tube when the rear chamber is being supplied with pressurized fluid and the front chamber is discharging pressurized fluid to the bottom of the hole.
Figure 3:
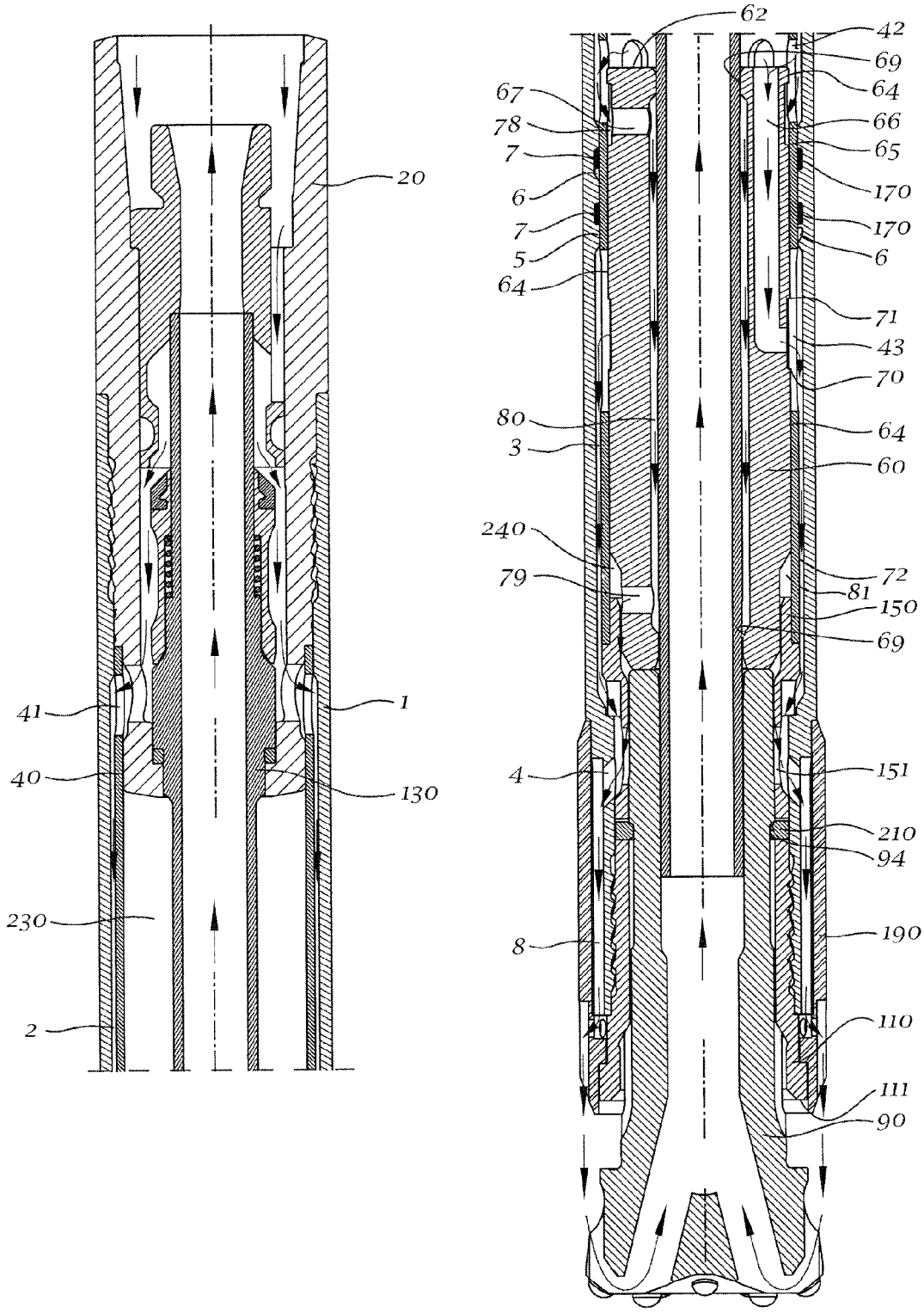
FIG. 3 depicts a longitudinal cross section view of the DTH reverse circulation DTH hammer of the invention specifically showing the disposition of the piston and the drill bit with respect to the outer casing, cylinder and sampling tube when the hammer is in flushing mode.

DETAILED DESCRIPTION OF A PREFERRED EMBODIMENT OF THE INVENTION (FIGS. 1 to 3)

Referring to FIGS. 1 to 3, a reverse circulation DTH hammer is shown having the pressurized fluid flow system according to the invention, wherein the hammer comprises the following main components:

a cylindrical outer casing (1);

a rear sub (20) affixed to the rear end of said outer casing (1) for connecting the hammer to the source of pressurized fluid;

a centrally-bored piston (60) slidably and coaxially disposed inside said outer casing (1) and capable of reciprocating due to the change in pressure of the pressurized fluid contained inside of a front chamber (240) and a rear chamber (230) located at opposites ends of the piston (60), the piston (60) having multiple inner sliding surfaces (69) and outer sliding surfaces (64);

a drill bit (90) slidably mounted in the front end of the hammer on a driver sub (110), the driver sub (110) being mounted in the front end of the outer casing (1), the drill bit (90) being aligned with the outer casing (1) by means of a drill bit guide (150) disposed inside said outer casing (1) and limited in its sliding movement by a drill bit retainer (210) and the drill bit supporting face (111) of the driver sub (110); and a sampling tube (130) coaxially disposed within the outer casing (1) and extending from the drill bit (90) to the rear sub (20).

The cylinder (40) is part of the pressurized fluid flow system of the invention and is disposed coaxially in between the outer casing (1) and the piston (60).

The rear chamber (230) of the hammer is defined by the rear sub (20), the cylinder (40), the sampling tube (130) and the rear thrust surface (62) of the piston (60). The volume of this chamber is variable and depends on the piston's (60) position. The front chamber (240) of the hammer is defined by the drill bit (90), the cylinder (40), the drill bit guide (150) and the front thrust surface (63) of the piston (60). The volume of this latter chamber is variable and also depends on the piston's (60) position.

The outer casing (1) has two chambers defined by respective recesses on its inner surface, a supply chamber (2) for supplying pressurized fluid to the front chamber (240) and to the rear chamber (230), and a discharge chamber (3) for discharging pressurized fluid from the front chamber (240) and from the rear chamber (230); both chambers internally delimited by the cylinder (40) and separated by a dividing wall (5). When the hammer is operative, the first of these chambers is in permanent fluid communication with the source of pressurized fluid and it is filled with said fluid while the second chamber is communicated with the bottom of the hole.

One or more flushing channels (6) are provided in said dividing wall (5), for allowing direct flow of pressurized fluid from the supply chamber (2) to the discharge chamber (3) in such a way that part of the flow of pressurized fluid available from the source of pressurized fluid may be discharged directly to the bottom of the hole, generating in this manner an assisted flushing system.

In the embodiments shown in FIGS. 1 to 3, the dividing wall (5) has annular seal-mounting grooves (7) with removable fluid seals (170) mounted on them. These annular seal-mounting grooves (7) are interlaced with said flushing channels (6) and the fluid seals (170) block the direct flow of pressurized fluid from the supply chamber (2) to the discharge chamber (3), disabling in this way the assisted flushing system. The withdrawal of such removable fluid seals (170) enables the assisted flushing system.

The outer casing (1) has at its front end portion a set of end discharge ports (4) connected to respective longitudinal discharge channels (8) formed on its outer surface, both having the function of conveying the flow of pressurized fluid from the discharge chamber (3) to the outside of the outer casing (1) and to the peripheral region of the front end of the drill bit (90). The end discharge ports (4) and longitudinal discharge channels (8) are covered by a sealing element such as a shroud or a cylindrical outer sealing sleeve (190).

The cylinder (40) has multiple supply through-ports (41, 42) and multiple discharge through-ports (43) respectively facing the supply and discharge chambers (2, 3). The piston (60) has fluid-conducting means (66, 67, 79, 80, 81) that allow the pressurized fluid to flow from the rear sub (20) to the supply chamber (2), from the supply chamber (2) to the front chamber (240) or to the rear chamber (230) and from the front chamber (240) or from the rear chamber (230) to the discharge chamber (3).

Control of the State of the Front Chamber (240)

When in the hammer cycle the impact face (61) of the piston (60) is in contact with the impact face (91) of the drill bit (90) and the drill bit (90) is at the rearmost point of its stroke, i.e. the hammer is at impact position (see FIG. 1), the front chamber (240) is in direct fluid communication with the supply chamber (2) through the front set of supply through-ports (42) of the cylinder (40), the rear set of supply conduits (67) of the piston (60), one or more central axial supply passages (80) formed in between the piston (60) and the sampling tube (130) and the front set of supply conduits (79) of the piston (60). As illustrated, the one or more central axial supply passages (80) are preferably defined by means of corresponding recesses in the inner sliding surfaces (69) of the piston (60) and are fluidly connected to the sets of supply conduits (67, 79). In this way, the pressurized fluid is able to freely flow from the supply chamber (2) to the front chamber (240) and start the movement of the piston (60) in the rearward direction.

This flow of pressurized fluid to the front chamber (240) will stop when the piston (60) has traveled in the front end to rear end direction of its stroke until the point where the front outer supply edge (65) of piston (60) reaches the rear limit of the front set of supply through-ports (42) of the cylinder (40). As the movement of the piston (60) continues further in the front end to rear end direction of its stroke, a point will be reached where the front outer discharge edge (72) of the piston (60) will match the front limit of the set of discharge through-ports (43) of the cylinder (40). As the movement of the piston (60) continues even further, the front chamber (240) of the hammer will become fluidly communicated with the discharge chamber (3) through the front undercut (81) of the piston (60) and through the set of discharge through-ports (43) of the cylinder (40) (see FIG. 2). In this way, the pressurized fluid contained inside the front chamber (240) will be discharged into the discharge chamber (3) and from this chamber it is able to freely flow out of the outer casing (1) through the end discharge ports (4) of the same, from where it is directed to the peripheral region of the front end of the drill bit (90), through the longitudinal discharge channels (8) of the outer casing (1). These ports (4) and channels (8) are covered by the shroud or outer sealing sleeve (190).

Control of the State of the Rear Chamber (230)

When in the hammer cycle the impact face (61) of the piston (60) is in contact with the impact face (91) of the drill bit (90) and the drill bit (90) is at the rearmost point of its stroke, i.e. the hammer is at impact position (see FIG. 1), the rear chamber (230) is in direct fluid communication with the discharge chamber (3) through bifunctional longitudinal passages (66) extending through the body of the piston (60), from the rear thrust surface (62) to the outer sliding surfaces (64) of the piston (60), and through the set of discharge through-ports (43) of the cylinder (40). In this way the pressurized fluid contained inside the rear chamber (230) is able to freely flow to the discharge chamber (3) and from the discharge chamber (3) it is able to freely flow out of the outer casing (1) through the end discharge ports (4) of the same, from where it is directed to the peripheral region of the front end of the drill bit (90), through the longitudinal discharge channels (8) of the outer casing (1), which are covered by the shroud or outer sealing sleeve (190).

This flow of pressurized fluid will stop when the piston (60) has traveled in the front end to rear end direction of its stroke until the lower outer discharge edge (70) of piston (60) reaches the rear limit of the set of discharge through-ports (43) of the cylinder (40). As the movement of the piston (60) continues further in the front end to rear end direction of its stroke, a point will be reached where the upper outer discharge edge (71) of the piston (60) matches the front limit of the front set of supply through-ports (42) of the cylinder sleeve (40) (see FIG. 2). As the movement of the piston (60) continues even further, the rear chamber (230) of the hammer will become fluidly communicated with the supply chamber (2) through the front set of supply through-ports (42) of the cylinder (40), and through the bifunctional longitudinal passages (66) of the piston (60). In this way, the rear chamber (230) will be supplied with pressurized fluid coming from the supply chamber (2).

Flushing Mode Operation

If the hammer is lifted in such a way that the drill bit (90) stops being in contact with the rock being drilled and the drill bit's retainer supporting shoulder (94) rests on the drill bit retainer (210), the drill bit (90) will reach the front end of its stroke and then the hammer switches to its flushing mode. In this position the percussion of the hammer stops, hence leaving the impact face (61) of the piston (60) resting on the impact face (91) of the drill bit (90) (see FIG. 3 for illustration of the flushing mode description while features (61) and (91) are shown in FIG. 2), and the pressurized fluid is conveyed directly to the peripheral region of the front end of the drill bit (90) through the following pathway: into the supply chamber (2) through the rear sub (20) and the rear set of supply through-ports (41) of the cylinder (40), and from the supply chamber (2) to the discharge chamber (3) through the front set of supply through-ports (42) of the cylinder (40), through the bifunctional longitudinal passages (66) and distribution undercut (78) of the piston (60), and through the set of discharge through-ports (43) of the cylinder (40). From the discharge chamber (3) the pressurized fluid is able to freely flow to the outside of the outer casing (1) through the end discharge ports (4) of the outer casing (1), from where it is directed to the peripheral region of the front end of the drill bit (90), through the longitudinal discharge channels (8) of the outer casing (1) covered by the shroud or outer sealing sleeve (190).

Pressurized fluid that could flow to the front chamber (240) is conveyed to the outside of the outer casing (1) through the discharge grooves (151) of the drill bit guide (150) and the set of end discharge ports (4) of the outer casing (1).

Figure 4:
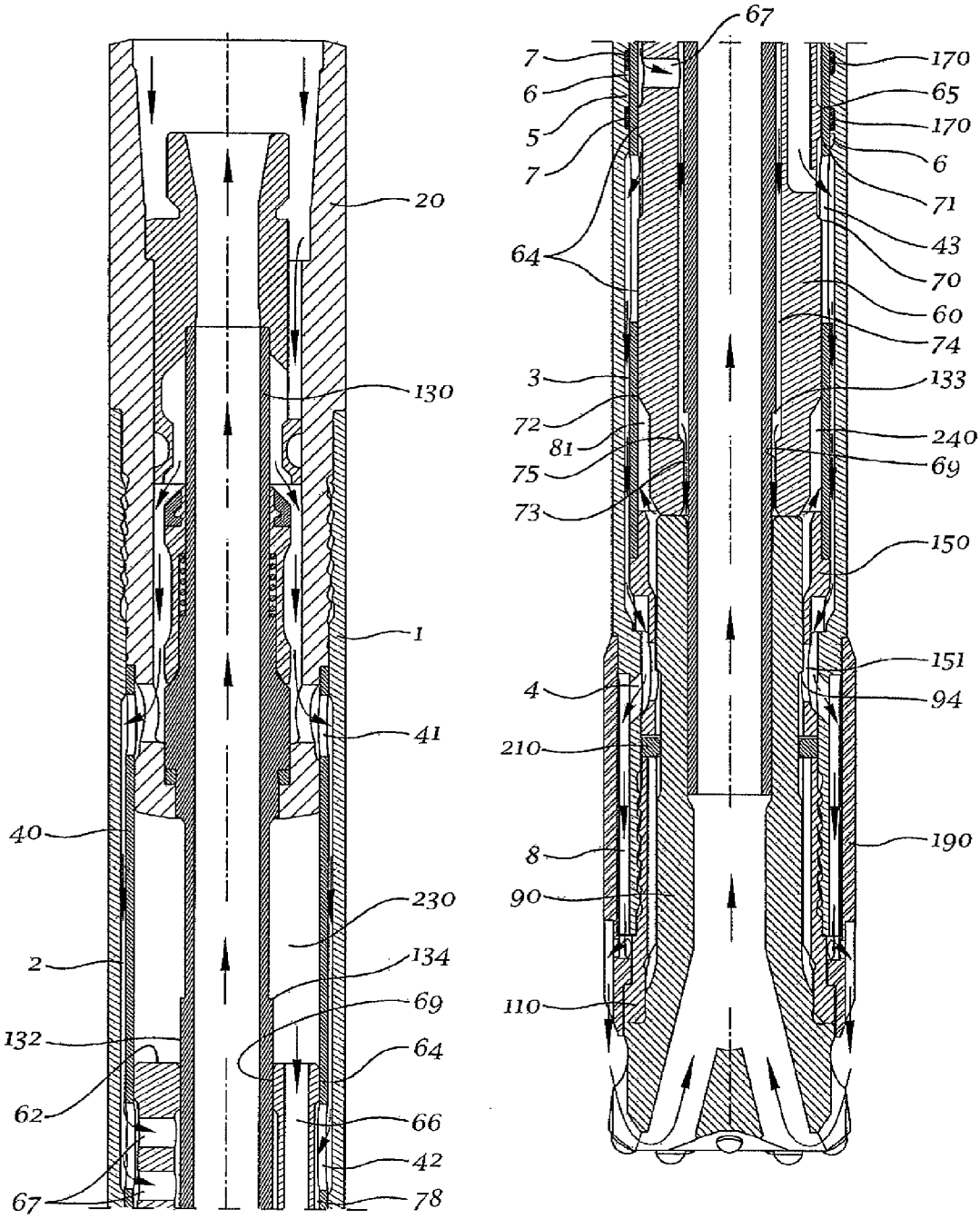
FIG. 4 depicts a longitudinal cross section view of a second embodiment of the reverse circulation DTH hammer of the invention specifically showing the disposition of the piston with respect to the outer casing, cylinder, drill bit and sampling tube when the front chamber is being supplied with pressurized fluid and the rear chamber is discharging pressurized fluid to the bottom of the hole.
Figure 5:
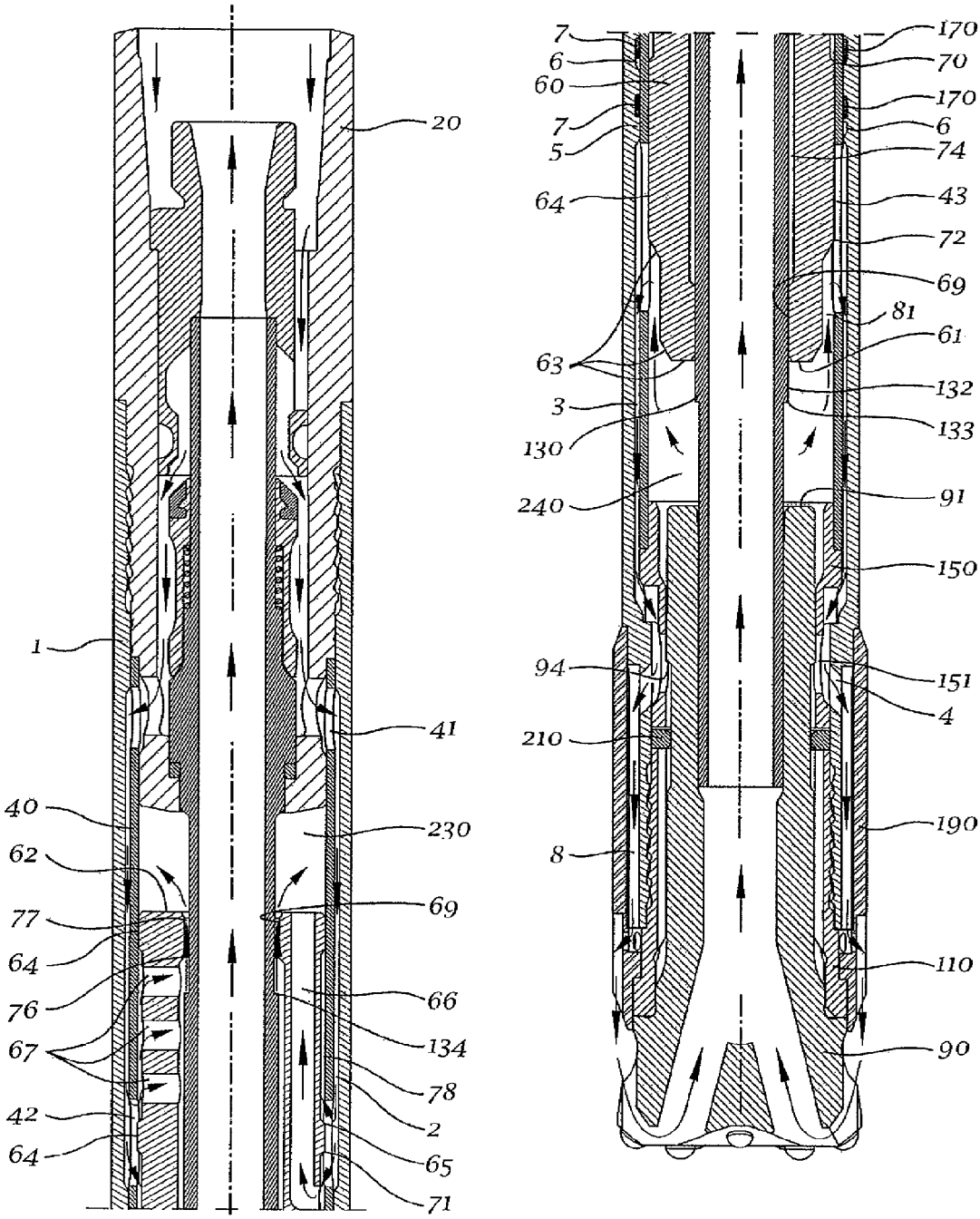
FIG. 5 depicts a longitudinal cross section view of the second embodiment of the reverse circulation DTH hammer of the invention specifically showing the disposition of the piston with respect to the outer casing, cylinder, drill bit and sampling tube when the rear chamber is being supplied with pressurized fluid and the front chamber is discharging pressurized fluid to the bottom of the hole.
Figure 6:
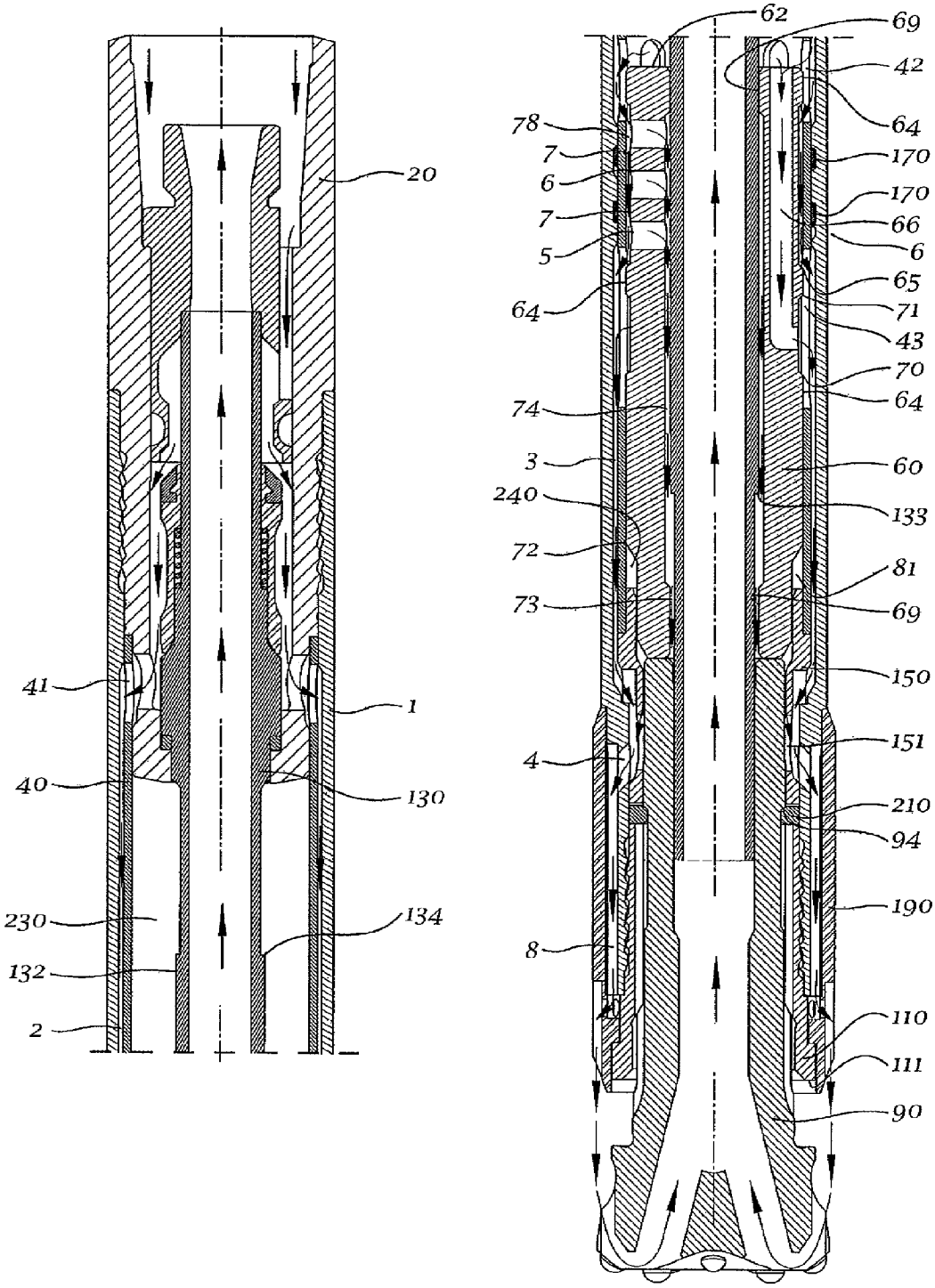
FIG. 6 depicts a longitudinal cross section view of the second embodiment of the reverse circulation DTH hammer of the invention specifically showing the disposition of the piston and the drill bit with respect to the outer casing, cylinder and sampling tube when the hammer is in flushing mode.

DETAILED DESCRIPTION OF A SECOND EMBODIMENT OF THE INVENTION (FIGS. 4 to 6)

Referring to FIGS. 4 to 6, a reverse circulation DTH hammer is shown having a second embodiment of the pressurized fluid flow system according to the invention, wherein the hammer is similar to that of FIGS. 1 to 3, except for: an internal chamber (74) defined by a recess of the inner sliding surfaces (69) of the piston (60) and in permanent fluid communication with the supply chamber (2); and except for the absence of a front set of supply conduits (79) in the piston (60), while the rear set of supply conduits (67) are disposed constantly connecting the supply chamber (2) with the internal chamber (74), through the front set of supply through-ports (42) of the cylinder (40) during the operation of the hammer. The internal chamber (74) is delimited by the piston (60) and the sampling tube (130) and it is disposed coaxial to both.

In this second embodiment of the invention, passages (73, 77) are formed in between the piston (60) and the sampling tube (130) for channeling the flow of pressurized fluid from the internal chamber (74) to the front and rear chambers (240, 230), as will be described hereinafter.

Control of the State of the Front Chamber (240)

When in the hammer cycle the impact face (61) of the piston (60) is in contact with the impact face (91) of the drill bit (90) and the drill bit (90) is at the rearmost point of its stroke, i.e. the hammer is at impact position (see FIG. 4), the internal chamber (74) is in direct fluid communication with the supply chamber (2) through the front set of supply through-ports (42) of the cylinder (40) and through the rear set of supply conduits (67) of the piston (60). At the same time, the internal chamber (74) is fluidly communicated with the front chamber (240) through a front passage (73) formed in between the front portion of the piston (60) and the sampling tube (130). From this front passage (73) the pressurized fluid can flow toward the front chamber (240) and begin the rearward movement of the piston (60). In this way the pressurized fluid is able to freely flow from the supply chamber (2) toward the front chamber (240) of the hammer.

This flow of pressurized fluid will stop when the piston (60) has traveled in the front end to rear end direction of its stroke until the point where the lower supply edge (75) of the piston (60) reaches the lower supply edge (133) of the sampling tube (130). As the movement of the piston (60) continues further in the front end to rear end direction of its stroke, a point will be reached where the front outer discharge edge (72) of the piston (60) matches the front limit of the set of discharge through-ports (43) of the cylinder (40). As the movement of the piston (60) continues even further, the front chamber (240) of the hammer will become fluidly communicated with the discharge chamber (3) through the front undercut (81) of the piston (60) and through the set of discharge through-ports (43) of the cylinder (40) (see FIG. 5). In this way, the pressurized fluid contained inside the front chamber (240) will be discharged into the discharge chamber (3) and from this chamber (3) it is able to freely flow out of the outer casing (1), through the end discharge ports (4) of the same, from where it is directed to the peripheral region of the front end of the drill bit (90), through the longitudinal discharge channels (8) of the outer casing (1). These ports (4) and channels (8) are covered by the shroud or outer sealing sleeve (190).

Control of the State of the Rear Chamber (230)

When in the hammer cycle the impact face (61) of the piston (60) is in contact with the impact face (91) of the drill bit (90) and the drill bit (90) is at the rearmost point of its stroke, i.e. the hammer is at impact position (see FIG. 4), the rear chamber (230) is in direct fluid communication with the discharge chamber (3) through the bifunctional longitudinal passages (66) of the piston (60) and the set of discharge through-ports (43) of the cylinder (40). In this way the pressurized fluid contained inside the rear chamber (230) is able to freely flow to the discharge chamber (3) and from the discharge chamber (3) it is able to freely flow out of the outer casing (1) through the end discharge ports (4) of same, from where it is directed to the peripheral region of the front end of the drill bit (90), through the longitudinal discharge channels (8) of the outer casing (1), which are covered by the shroud or outer sealing sleeve (190).

This flow of pressurized fluid will stop when the piston (60) has traveled in the front end to rear end direction of its stroke until the lower outer discharge edge (70) of piston (60) reaches the rear limit of the set of discharge through-ports (43) of the cylinder (40). As the movement of the piston (60) continues further in the front end to rear end direction of its stroke, a point will be reached where the upper supply edge (76) of the piston (60) matches the upper supply edge (134) of the sampling tube (130) (Optionally, almost simultaneously, the upper outer discharge edge (71) of the piston (60) can match the front limit of the front set of supply through-ports (42) of the cylinder (40) to improve the rear chamber filling process). As the movement of the piston (60) continues even further, the rear chamber (230) of the hammer becomes fluidly communicated with the internal chamber (74) of the piston (60) through a rear passage (77) formed in between the rear portion of the piston (60) and the sampling tube (130) (see FIG. 5). In this position, the internal chamber (74) of the piston (60) is in direct fluid communication with the supply chamber (2) through the front set of supply through-ports (42) of the cylinder (40) and the rear set of supply conduits (67) of the piston (60). Simultaneously, the bifunctional longitudinal passages (66) of the piston (60) become fluidly communicated with the supply chamber (2) through the front set of supply through-ports (42) of the cylinder (40). In this way, the rear chamber (230) will be filled with pressurized fluid coming from the supply chamber (2).

Flushing Mode Operation

In the flushing mode of the hammer, i.e. when the percussion of the hammer stops, the impact face (61) of the piston (60) rests on the impact face (91) of the drill bit (90), and the pressurized fluid is conveyed directly to the peripheral region of the front end of the drill bit (90) through the following pathway: into the supply chamber (2) through the rear sub (20) and the rear set of supply through-ports (41) of the cylinder (40), and from the supply chamber (2) to the discharge chamber (3) through the front set of supply through-ports (42) of the cylinder (40), through the bifunctional longitudinal passages (66) and distribution undercut (78) of the piston (60), and through the set of discharge through-ports (43) of the cylinder (40). From the discharge chamber (3) the pressurized fluid is able to flow freely to the outside of the outer casing (1) through the end discharge ports (4) of the outer casing (1), from where it is directed to the peripheral region of the front end of the drill bit (90), through the longitudinal discharge channels (8) of the outer casing (1) covered by the shroud or outer sealing sleeve (190).

Pressurized fluid that could flow to the front chamber (240) is conveyed to the outside of the outer casing (1) through the discharge grooves (151) of the drill bit guide (150) and the set of end discharge ports (4) of the outer casing (1).

Though the above has been described with reference to the application of the invention to a reverse circulation DTH hammer, it becomes evident for an expert in the field that the flow system illustrated in FIGS. 1, 2, 3, 4, 5 and 6 is equally applicable to a normal circulation DTH hammer.

The invention claimed is:

1. A pressurized fluid flow system for a reverse circulation down-the-hole hammer, the hammer comprising:

a cylindrical outer casing (1);

a rear sub (20) affixed to the rear end of said outer casing (1) for connecting the hammer to the source of pressurized fluid;

a centrally-bored piston (60) slidably and coaxially disposed inside said outer casing (1) and capable of reciprocating due to the change in pressure of the pressurized fluid contained inside of a front chamber (240) and a rear chamber (230) located at opposites sides of the piston (60), the piston (60) having multiple inner sliding surfaces (69) and outer sliding surfaces (64);

a drill bit (90) slidably mounted in the front end of the hammer in a driver sub (110), the driver sub (110) being mounted in the front end of the outer casing (1); and a sampling tube (130) coaxially disposed within the outer casing (1) and extending from the drill bit (90) to the rear sub (20);

wherein the pressurized fluid flow system comprises:

a cylinder (40) disposed coaxially in between the outer casing (1) and the piston (60);

a supply chamber (2) for supplying pressurized fluid to the front chamber (240) and to the rear chamber (230), and a discharge chamber (3) for discharging pressurized fluid from the front chamber (240) and from the rear chamber (230), the supply and discharge chambers (2, 3) defined by respective recesses on the inner surface of the outer casing (1);

the supply and discharge chambers (2, 3) being internally delimited by the cylinder (40) and separated by a dividing wall (5);

the supply chamber (2) being in permanent fluid communication with the source of pressurized fluid;

the discharge chamber (3) being in permanent fluid communication with the bottom of the hole being drilled by the hammer;

multiple supply through-ports (42) and discharge through-ports (43) provided in said cylinder (40) respectively facing the supply and discharge chambers (2, 3);

a first set of fluid-conducting means (67, 79, 80, 81) provided in said piston (60) for connecting the outer sliding surfaces (64) of the piston (60) with the front chamber (240) and channelling the flow of pressurized fluid a) from the supply chamber (2), through multiple supply through-ports (42) of the cylinder (40), into the front chamber (240), and b) out of the front chamber (240), through multiple discharge through-ports (43) of the cylinder (40), into the discharge chamber (3); and a second set of fluid-conducting means (66) provided in said piston (60) for connecting the outer sliding surfaces (64) of the piston (60) with the rear chamber (230) and channeling the flow of pressurized fluid a) from the supply chamber (2), through multiple supply through-ports (42) of the cylinder (40), into the rear chamber (230), and b) out of the rear chamber (230), through multiple discharge through-ports (43) of the cylinder (40), into the discharge chamber (3);

whereby the flow of pressurized fluid into and out of the front and rear chambers (240, 230) is controlled solely by the overlap or relative position of said multiple outer sliding surfaces (64) of the piston (60) and the inner surface of the cylinder (40) during the alternating movement of the piston (60).

2. The pressurized fluid flow system of claim 1, wherein the fluid-conducting means of the piston (60) comprise:

a front set of supply conduits (79), a rear set of supply conduits (67) and one or more central axial supply passages (80) for conveying pressurized fluid from the supply chamber (2) into the front chamber (240) through the multiple supply through-ports (42) of the cylinder (40), wherein the one or more central axial supply passages (80) are fluidly connected to the supply conduits (67, 79) and defined by corresponding recesses on the inner sliding surfaces (69) of the piston (60); and bifunctional longitudinal passages (66) extending through the body of the piston (60) for conveying pressurized fluid from the supply chamber (2) to the rear chamber (230) through the front set of supply through-ports (42) and for conveying pressurized fluid from the rear chamber (230) to the discharge chamber (3) through the set of discharge through-ports (43); and a front undercut (81) for conveying pressurized fluid from the front chamber (240) to the discharge chamber (3) through the set of discharge through-ports (43).

3. The pressurized fluid flow system of claim 1, wherein the cylinder (40) has a rear set of supply through-ports (41) for permitting the pressurized fluid to flow from the rear sub (20) to the supply chamber (2).

4. A pressurized fluid flow system for a reverse circulation down-the-hole hammer, the hammer comprising:

a cylindrical outer casing (1);

a rear sub (20) affixed to the rear end of said outer casing (1) for connecting the hammer to the source of pressurized fluid;

a centrally-bored piston (60) slidably and coaxially disposed inside said outer casing (1) and capable of reciprocating due to the change in pressure of the pressurized fluid contained inside of a front chamber (240) and a rear chamber (230) located at opposites sides of the piston (60), the piston (60) having multiple inner sliding surfaces (69) and outer sliding surfaces (64);

a drill bit (90) slidably mounted in the front end of the hammer on a driver sub (110), the driver sub (110) being mounted in the front end of the outer casing (1); and a sampling tube (130) coaxially disposed within the outer casing (1) and extending from the drill bit (90) to the rear sub (20); the sampling tube having an outer sliding surface (132);

wherein the pressurized fluid flow system comprises:

a cylinder (40) disposed coaxially in between the outer casing (1) and the piston (60);

a supply chamber (2) for supplying pressurized fluid to the front chamber (240) and to the rear chamber (230), and a discharge chamber (3) for discharging pressurized fluid from the front chamber (240) and from the rear chamber (230), the supply and discharge chambers (2, 3) defined by respective recesses on the inner surface of the outer casing (1);

the supply and discharge chambers (2, 3) being internally delimited by the cylinder (40) and separated by a dividing wall (5);

the supply chamber (2) being in permanent fluid communication with the source of pressurized fluid;

the discharge chamber (3) being in permanent fluid communication with the bottom of the hole being drilled by the hammer;

multiple supply and discharge through-ports (42, 43) provided in said cylinder (40) respectively facing the supply and discharge chambers (2, 3);

the piston (60) having:

an internal chamber (74) defined by a recess on the inner sliding surfaces (69) of the piston (60) and delimited by the sampling tube (130), the internal chamber (74) being in permanent fluid communication with the supply chamber (2);

a first set of fluid-conducting means (67) for allowing said permanent fluid communication between the internal chamber (74) and the supply chamber (2);

a second set of fluid-conducting means (66) for connecting the outer sliding surfaces (64) of the piston (60) with the rear chamber (230) and channeling the flow of pressurized fluid from the rear chamber (230), through multiple discharge through-ports (43) of the cylinder (40), into the discharge chamber (3); and a third set of fluid-conducting means (81) for connecting the outer sliding surfaces (64) of the piston (60) with the front chamber (240) and channeling the flow of pressurized fluid from the front chamber (240), through multiple discharge through-ports (43) of the cylinder (40), into the discharge chamber (3); and passages (73, 77) formed in between the piston (60) and the sampling tube (130) for channeling the flow of pressurized fluid from the internal chamber (74) into the front and rear chambers (240, 230);

whereby the flow of pressurized fluid into the front and rear chambers (240, 230) is controlled by the overlap or relative position of said multiple inner sliding surfaces (69) of the piston (60) and said outer sliding surface (132) of the sampling tube (130) during the alternating movement of the piston (60); and whereby the flow of pressurized fluid out of the front and rear chambers (240, 230) is controlled by the overlap or relative position of said multiple outer sliding surfaces (64) of the piston (60) and the inner surface of the cylinder (40) during the alternating movement of the piston (60).

5. The pressurized fluid flow system of claim 1 or 4, wherein the supply chamber (2) is disposed in series longitudinally with the discharge chamber (3).

6. The pressurized fluid flow system of claim 1 or 4, wherein the pressurized fluid flow system comprises one or more flushing channels (6) built on the dividing wall (5) for allowing fluid communication between the supply chamber (2) and the discharge chamber (3) and conveyance of part of the flow of pressurized fluid available from the source of pressurized fluid to the bottom of the hole being drilled by the hammer to.

7. The pressurized fluid flow system of claim 6, wherein the flushing channels (6) on the dividing wall (5) are interlaced with annular seal-mounting grooves (7) for mounting on them removable fluid seals (170) that when mounted on the grooves (7) disable the assisted flushing system.

8. The pressurized fluid flow system of claim 4, wherein the internal chamber (74) is disposed coaxial with both the piston (60) and the sampling tube (130).

9. The pressurized fluid flow system of claim 6, wherein the flushing channels (6) on the dividing wall (5) are longitudinal channels.

10. The pressurized fluid flow system of claim 6, wherein the flushing channels (6) are preferably helixes.

11. A down-the-hole reverse circulation hammer comprising the pressurized fluid flow system of claims 1 or, wherein the outer casing (1) has at its front end portion thereof a set of end discharge ports (4) for channeling the pressurized fluid flow from the discharge chamber (3) to the outside of the outer casing (1).

12. The down-the-hole reverse circulation hammer of claim 11, wherein the end discharge ports (4) are aligned with respective longitudinal discharge channels (8) formed on the outer surface of the front end portion of the outer casing (1).

13. The down-the-hole reverse circulation hammer of claim 11, wherein the end discharge ports (4) and longitudinal discharge channels (8) are covered by a sealing element for preventing leakage of pressurized fluid and rock cuttings into the annular space between the hammer and the hole and for directing the pressurized fluid to the peripheral region of the front end of the drill bit (90) and forcing the same and the rock cuttings from the bottom of the hole through the sampling tube.

14. The down-the-hole reverse circulation hammer of claim 13, wherein the sealing element is a shroud or outer sealing sleeve (190).

* * * * *